US011852389B2

(12) United States Patent
Shanmugam

(10) Patent No.: US 11,852,389 B2
(45) Date of Patent: Dec. 26, 2023

(54) REFRIGERATION SYSTEM WITH FLEXIBLE HIGH PRESSURE HOSE ASSEMBLY

(71) Applicant: Hill Phoenix, Inc., Conyers, GA (US)

(72) Inventor: Senthilkumar Kandappa Goundar Shanmugam, Covington, GA (US)

(73) Assignee: Hill Phoenix, Inc., Conyers, GA (US)

( * ) Notice: Subject to any disclaimer, the term of this patent is extended or adjusted under 35 U.S.C. 154(b) by 421 days.

(21) Appl. No.: 16/817,222

(22) Filed: Mar. 12, 2020

(65) Prior Publication Data

US 2021/0285702 A1 Sep. 16, 2021

(51) Int. Cl.
*F25B 41/40* (2021.01)
*F25B 9/00* (2006.01)

(52) U.S. Cl.
CPC ..... *F25B 41/40* (2021.01); *F25B 9/008* (2013.01); *F25B 2309/06* (2013.01); *F25B 2339/0242* (2013.01); *F25B 2500/13* (2013.01); *F25B 2500/22* (2013.01)

(58) Field of Classification Search
CPC ..... F25B 41/40; F25B 9/008; F25B 2309/06; F25B 2339/0242; F25B 2500/13
See application file for complete search history.

(56) References Cited

U.S. PATENT DOCUMENTS

| | | | | |
|---|---|---|---|---|
| 2010/0287960 | A1 | 11/2010 | Meister | |
| 2016/0282026 | A1* | 9/2016 | Park | F24F 11/86 |
| 2018/0216851 | A1* | 8/2018 | Christensen | F25B 5/00 |
| 2020/0240561 | A1* | 7/2020 | Tan | F16L 27/0861 |

FOREIGN PATENT DOCUMENTS

| | | | | |
|---|---|---|---|---|
| CN | 102829262 B | * | 2/2015 | |
| CN | 205806781 U | * | 12/2016 | |
| CN | 108351125 A | * | 7/2018 | F16L 11/11 |
| JP | 2018189312 A | * | 11/2018 | |
| JP | 2019002348 A | * | 1/2019 | |
| WO | WO 2014179442 | | 11/2014 | |

OTHER PUBLICATIONS

International Search Report and Written Opinion in International AppIn. No. PCT/US2021/021962, dated Jun. 23, 2021, 10 pages.

* cited by examiner

*Primary Examiner* — Ana M Vazquez
(74) *Attorney, Agent, or Firm* — Fish & Richardson P.C.

(57) ABSTRACT

A $CO_2$ refrigeration system, includes a receiving tank, a condenser, a low temperature system, and a medium temperature system. The low temperature system is fluidly coupled to the receiving tank and the condenser. The low temperature system includes a plurality of low temperature evaporators, a plurality of low temperature expansion valves, a plurality of low temperature compressors, and a plurality of flexible low temperature conduits fluidly coupling the low temperature compressors to a low temperature discharge header and a low temperature suction header. The medium temperature system is fluidly coupled to the receiving tank and the low temperature system. The medium temperature system includes a plurality of medium temperature evaporators, a plurality of medium temperature expansion valves, a plurality of medium temperature compressors, and a plurality of flexible medium temperature conduits fluidly coupling the medium temperature compressors to a medium temperature discharge header and a medium temperature suction header.

24 Claims, 4 Drawing Sheets

REFRIGERATION SYSTEM WITH FLEXIBLE HIGH PRESSURE HOSE ASSEMBLY

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this Application and is not admitted to be prior art by inclusion in this section.

The present description relates generally to a refrigeration system primarily using carbon dioxide (i.e., $CO_2$) as a refrigerant. The present description relates more particularly to systems including a flexible conduit for dampening vibrations and pressure pulsations to limit disconnection of the flexible conduit from a transfer conduit or a compressor.

SUMMARY

One aspect of the present disclosure relates to a CO2 refrigeration system. The $CO_2$ refrigeration system, comprising a receiving tank to contain a quantity of liquid and gaseous $CO_2$, a condenser fluidly coupled to the receiving tank, a low temperature system fluidly coupled to the receiving tank, and a medium temperature system fluidly coupled to the receiving tank and the low temperature system. The low temperature system includes a plurality of low temperature evaporators, a plurality of low temperature expansion valves, a plurality of low temperature compressors, a low temperature suction header, a low temperature discharge header, and a plurality of flexible low temperature conduits fluidly coupling the low temperature compressors to the low temperature discharge header and the low temperature suction header. The medium temperature system includes a plurality of medium temperature evaporators, a plurality of medium temperature expansion valves, a plurality of medium temperature compressors, a medium temperature suction header, a medium temperature discharge header, and a plurality of flexible medium temperature conduits fluidly coupling the medium temperature compressors to the medium temperature discharge header and the medium temperature suction header.

Another aspect of the present disclosure relates to a CO2 refrigeration system. The CO2 refrigeration system includes a receiving tank to contain a quantity of liquid and gaseous $CO_2$, a condenser fluidly coupled to the receiving tank, a plurality of evaporators, a plurality of expansion valves fluidly disposed between the evaporators and the receiving tank, a plurality of compressors fluidly coupled to the plurality of evaporators, and a plurality of flexible conduits fluidly coupled to an outlet of the compressors and an inlet of the compressors.

Another aspect of the present disclosure relates to a refrigeration system. The refrigeration system includes one or more compressors, a compressor discharge header, a compressor suction header, and one or more flexible conduits. The one or more flexible conduits fluidly coupling an outlet of the one or more compressors to the compressor discharge header and an inlet of the one or more compressors to the compressor suction header.

DETAILED DESCRIPTION

Figure 1:
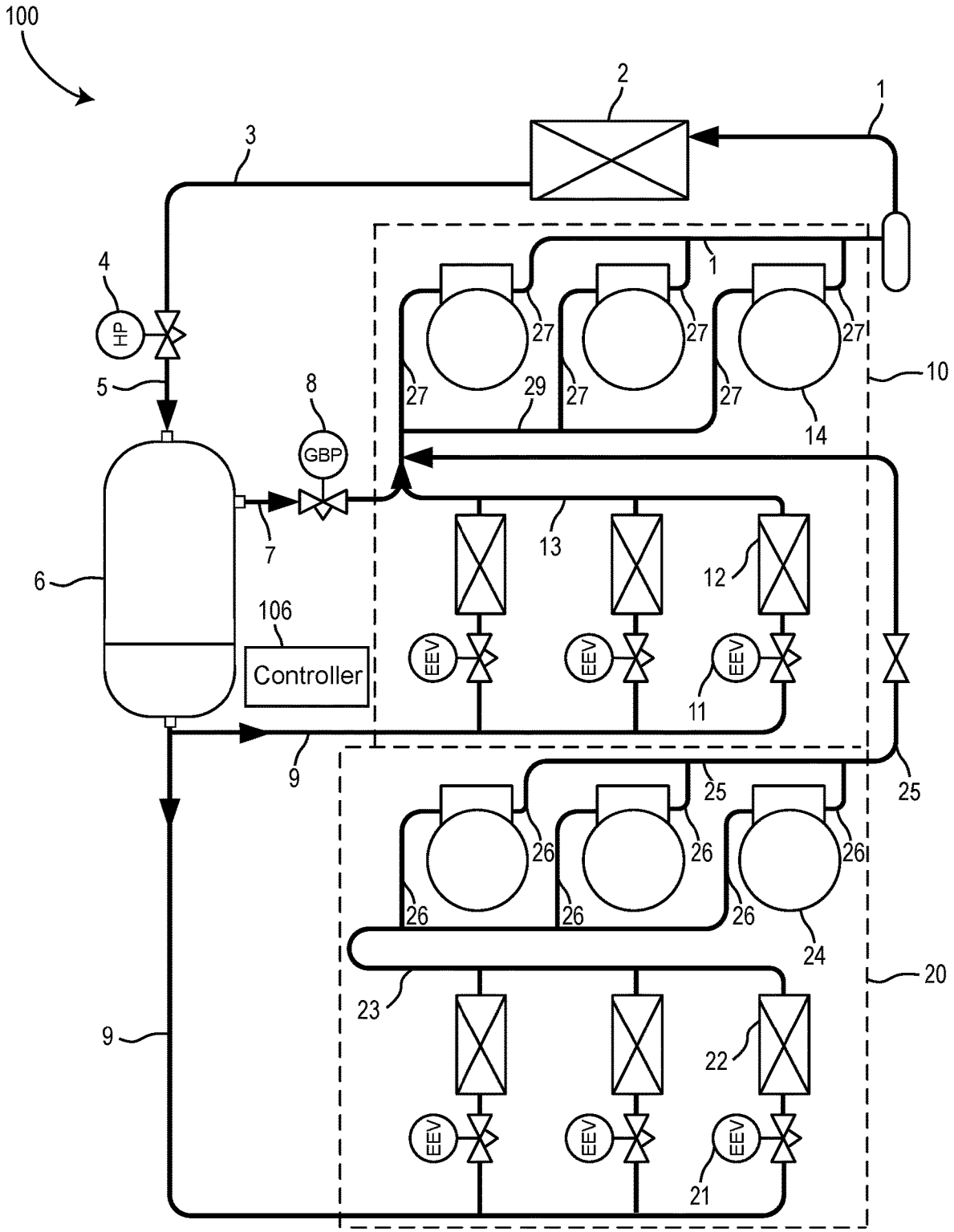
FIG. 1 is a schematic representation of a CO2 refrigeration system having a CO2 refrigeration circuit, a receiving tank for containing a mixture of liquid and vapor CO2 refrigerant, and a gas bypass valve fluidly connected with the receiving tank for controlling a pressure within the receiving tank, according to an exemplary embodiment.

Referring generally to the FIGURES, a CO2 refrigeration system and components thereof are shown, according to various exemplary embodiments. The CO2 refrigeration system may be a vapor compression refrigeration system which uses primarily carbon dioxide (i.e., CO2) as a refrigerant. In some implementations, the CO2 refrigeration system may be used to provide cooling for temperature controlled display devices in a supermarket or other similar facility.

In some embodiments, the CO2 refrigeration system includes a receiving tank (e.g., a flash tank, a refrigerant reservoir, etc.) containing a mixture of CO2 liquid and CO2 vapor, a gas bypass valve, and a parallel compressor. The gas bypass valve may be arranged in series with one or more compressors of the CO2 refrigeration system. The gas bypass valve provides a mechanism for controlling the CO2 refrigerant pressure within the receiving tank by venting excess CO2 vapor to the suction side of the CO2 refrigeration system compressors. The parallel compressor may be arranged in parallel with both the gas bypass valve and with other compressors of the CO2 refrigeration system. The parallel compressor provides an alternative or supplemental means for controlling the pressure within the receiving tank.

Advantageously, the CO2 refrigeration system includes a flexible conduit. The flexible conduit is fluidly coupled to a discharge header shown as a transfer conduit, and an outlet or a discharge of the one or more compressors. The flexible conduit includes a quick connect on an outlet side, a rigid pipe on an inlet side, and a flexible pipe segment (e.g., hose, tube, lumen, etc.) connecting the rigid pipe to the quick connect. The quick connect is coupled to the transfer conduit, and the rigid pipe is coupled to the discharge of the compressor. The flexible pipe is intended to dampen vibration or pressure pulsations within the flexible conduit and limit disconnection of the quick connect and the rigid pipe from the transfer conduit and the discharge, respectively. For example, the flexible pipe is intended to reduce the transmission of vibration from the compressor to the discharge header. According to one embodiment, the reduction in vibration transmission may be a reduction be a factor of 2, or 5, or 10 (or more) relative to a conventional hard-piped conduit arrangement between the compressor and the discharge header.

Before discussing further details of the CO2 refrigeration system and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, transmission of forces, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring now to FIG. 1, a CO2 refrigeration system 100 is shown according to an exemplary embodiment. CO2 refrigeration system 100 may be a vapor compression refrigeration system which uses primarily carbon dioxide as a refrigerant. CO2 refrigeration system 100 and is shown to include a system of pipes, conduits, or other fluid channels (e.g., fluid conduits 1, 3, 5, 7, 9, 25, 26, and 27) for transporting the carbon dioxide between various thermodynamic components of the refrigeration system. The thermodynamic components of CO2 refrigeration system 100 are shown to include a gas cooler/condenser 2, a high pressure valve 4, a receiving tank 6, a gas bypass valve 8, a medium-temperature ("MT") system portion 10, and a low-temperature ("LT") system portion 20.

Gas cooler/condenser 2 may be a heat exchanger or other similar device for removing heat from the CO2 refrigerant. Gas cooler/condenser 2 is shown receiving CO2 vapor from fluid conduit 1 (e.g. the medium temperature discharge header or transfer conduit). In some embodiments, the CO2 vapor in fluid conduit 1 may have a pressure within a range from approximately 45 bar to approximately 100 bar (i.e., about 640 psig to about 1420 psig), depending on ambient temperature and other operating conditions. In some embodiments, gas cooler/condenser 2 may partially or fully condense CO2 vapor into liquid CO2 (e.g., if system operation is in a subcritical region). The condensation process may result in fully saturated CO2 liquid or a liquid-vapor mixture (e.g., having a thermodynamic quality between 0 and 1). In other embodiments, gas cooler/condenser 2 may cool the CO2 vapor (e.g., by removing superheat) without condensing the CO2 vapor into CO2 liquid (e.g., if system operation is in a supercritical region). In some embodiments, the cooling/condensation process is an isobaric process. Gas cooler/condenser 2 is shown outputting the cooled and/or condensed CO2 refrigerant into fluid conduit 3.

High pressure valve 4 receives the cooled and/or condensed CO2 refrigerant from fluid conduit 3 and outputs the CO2 refrigerant to fluid conduit 5. High pressure valve 4 may control the pressure of the CO2 refrigerant in gas cooler/condenser 2 by controlling an amount of CO2 refrigerant permitted to pass through high pressure valve 4. In some embodiments, high pressure valve 4 is a high pressure thermal expansion valve (e.g., if the pressure in fluid conduit 3 is greater than the pressure in fluid conduit 5). In such embodiments, high pressure valve 4 may allow the CO2 refrigerant to expand to a lower pressure state. The expansion process may be an isenthalpic and/or adiabatic expansion process, resulting in a flash evaporation of the high pressure CO2 refrigerant to a lower pressure, lower temperature state. The expansion process may produce a liquid/vapor mixture (e.g., having a thermodynamic quality between 0 and 1). In some embodiments, the CO2 refrigerant expands to a pressure of approximately 38 bar (e.g., about 540 psig), which corresponds to a temperature of approximately 37° F. The CO2 refrigerant then flows from fluid conduit 5 into receiving tank 6.

Receiving tank 6 collects the CO2 refrigerant from fluid conduit 5. In some embodiments, receiving tank 6 may be a flash tank or other fluid reservoir. Receiving tank 6 includes a CO2 liquid portion and a CO2 vapor portion and may contain a partially saturated mixture of CO2 liquid and CO2 vapor. In some embodiments, receiving tank 6 separates the CO2 liquid from the CO2 vapor. The CO2 liquid may exit receiving tank 6 through fluid conduits 9. Fluid conduits 9 may be liquid headers leading to either MT system portion 10 or LT system portion 20. The CO2 vapor may exit receiving tank 6 through fluid conduit 7. Fluid conduit 7 is shown leading the CO2 vapor to gas bypass valve 8.

Gas bypass valve 8 is shown receiving the CO2 vapor from fluid conduit 7 and outputting the CO2 refrigerant to a suction header 29 positioned within MT system portion 10. In some embodiments, gas bypass valve 8 may be operated to regulate or control the pressure within receiving tank 6 (e.g., by adjusting an amount of CO2 refrigerant permitted to pass through gas bypass valve 8). For example, gas bypass valve 8 may be adjusted (e.g., variably opened or closed) to adjust the mass flow rate, volume flow rate, or other flow rates of the CO2 refrigerant through gas bypass valve 8. Gas bypass valve 8 may be opened and closed (e.g., manually, automatically, by a controller, etc.) as needed to regulate the pressure within receiving tank 6.

In some embodiments, gas bypass valve 8 includes a sensor for measuring a flow rate (e.g., mass flow, volume flow, etc.) of the CO2 refrigerant through gas bypass valve 8. In other embodiments, gas bypass valve 8 includes an indicator (e.g., a gauge, a dial, etc.) from which the position of gas bypass valve 8 may be determined. This position may be used to determine the flow rate of CO2 refrigerant through gas bypass valve 8, as such quantities may be proportional or otherwise related.

In some embodiments, gas bypass valve 8 may be a thermal expansion valve (e.g., if the pressure on the downstream side of gas bypass valve 8 is lower than the pressure in fluid conduit 7). According to one embodiment, the pressure within receiving tank 6 is regulated by gas bypass valve 8 to a pressure of approximately 38 bar, which corresponds to about 37° F. Advantageously, this pressure/temperature state (i.e., approximately 38 bar, approximately 37° F.) may facilitate the use of copper tubing/piping for the downstream CO2 lines of the system. Additionally, this pressure/temperature state may allow such copper tubing to operate in a substantially frost-free manner.

Still referring to FIG. 1, MT system portion 10 is shown to include one or more expansion valves 11, one or more MT evaporators 12, and one or more MT compressors 14. In various embodiments, any number of expansion valves 11, MT evaporators 12, and MT compressors 14 may be present. Expansion valves 11 may be electronic expansion valves or other similar expansion valves. Expansion valves 11 are shown receiving liquid CO2 refrigerant from fluid conduit 9 and outputting the CO2 refrigerant to MT evaporators 12. Expansion valves 11 may cause the CO2 refrigerant to undergo a rapid drop in pressure, thereby expanding the CO2 refrigerant to a lower pressure, lower temperature state. In some embodiments, expansion valves 11 may expand the CO2 refrigerant to a pressure of approximately 30 bar. The expansion process may be an isenthalpic and/or adiabatic expansion process.

MT evaporators 12 are shown receiving the cooled and expanded CO2 refrigerant from expansion valves 11. In some embodiments, MT evaporators may be associated with display cases/devices (e.g., if CO2 refrigeration system 100 is implemented in a supermarket setting). MT evaporators 12 may be configured to facilitate the transfer of heat from the display cases/devices into the CO2 refrigerant. The added heat may cause the CO2 refrigerant to evaporate partially or completely. According to one embodiment, the CO2 refrigerant is fully evaporated in MT evaporators 12. In some embodiments, the evaporation process may be an isobaric process. MT evaporators 12 are shown outputting the CO2 refrigerant via fluid conduits 13, leading to MT compressors 14.

MT compressors 14 compress the CO2 refrigerant into a superheated vapor having a pressure within a range of approximately 45 bar to approximately 100 bar. The output pressure from MT compressors 14 may vary depending on ambient temperature and other operating conditions. In some embodiments, MT compressors 14 operate in a transcritical mode. In operation, the CO2 discharge gas exits MT compressors 14 to a medium temperature discharge header 1. A flexible fluid conduit 27 is fluidly connected to the discharge of MT compressors 14. The CO2 discharge gas flows through fluid conduits 27 to medium temperature discharge header 1, and then into gas cooler/condenser 2. Flexible fluid conduits also are fluidly connected to a suction of MT compressors 14. The suction of MT compressors 14 receives CO2 from a suction header 29 via flexible fluid conduits 27.

Figure 4:
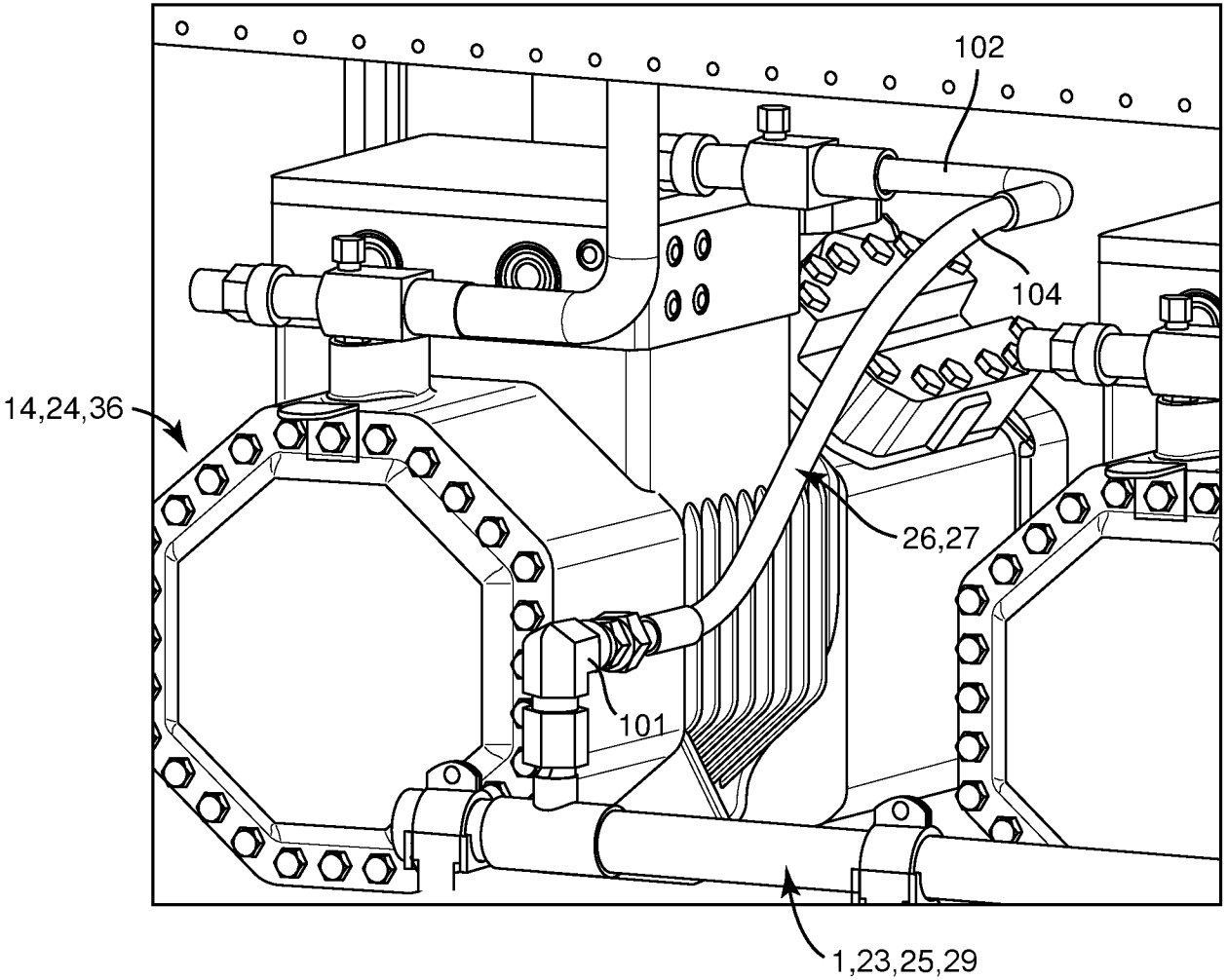
FIG. 4 is a partial view of a CO2 refrigeration system having a compressor, a flexible conduit, and a transfer conduit, according to an exemplary embodiment.

Flexible fluid conduits 26 and 27 are shown in FIG. 4 to include a quick connect 101 (e.g. connector, coupling, etc.) at an outlet end, a rigid pipe segment 102 at an inlet end, and a flexible pipe segment 104 between the quick connect 101 and the rigid pipe segment 102. The quick connect 101 may connect to discharge header 1 or 25, or to suction header 23 or 29. The rigid pipe 102 is shown to connect to the discharge or the suction of MT compressors 14, LT compressors 24, or parallel compressor 36. The flexible pipe 104 of fluid conduits 26 and 27 is intended to dampen vibration, pressure pulsation, or other forms of energy transfer within the flexible conduits 26 and 27 and limit disconnection (e.g. separation, degradation, fatigue, failure, etc.) of the quick connect 101 and the rigid pipe 102 from the discharge header 1 or 25 or the suction header 23 or 29, and the discharge or the suction of MT compressors 14, LT compressors 24, or parallel compressor 36, respectively. Suitable materials for the flexible pipe 104 may be, for example, a three layer hose (e.g., of a type having an inner core elastomer layer, a middle steel braided wire layer, and outer elastomer cover layer, or a corrugated inner core layer and a double outer wire braid layer), or a two layer hose (e.g., PTFE inner core and 304SS outer wire braid cover). The materials for the flexible pipe are intended to withstand the temperature and pressure of the high temperature CO2 discharged from the compressor, such as (for example) a temperature of up to 285° F. and a burst pressure of 130-140 bar. According to one non-limiting embodiment, the flexible pipe 104 may have a length within a range of approximately 1-4 feet long and have an outer diameter within a range of approximately 0.4-2.25 inch, and an inner diameter within a range of approximately 0.25-1.625 inch, although other dimensions may be used to suit a particular application.

Still referring to FIG. 1, LT system portion 20 is shown to include one or more expansion valves 21, one or more LT evaporators 22, and one or more LT compressors 24. In various embodiments, any number of expansion valves 21, LT evaporators 22, and LT compressors 24 may be present.

Expansion valves 21 may be electronic expansion valves or other similar expansion valves. Expansion valves 21 are shown receiving liquid CO2 refrigerant from fluid conduit 9 and outputting the CO2 refrigerant to LT evaporators 22. Expansion valves 21 may cause the CO2 refrigerant to undergo a rapid drop in pressure, thereby expanding the CO2 refrigerant to a lower pressure, lower temperature state. The expansion process may be an isenthalpic and/or adiabatic expansion process. In some embodiments, expansion valves 21 may expand the CO2 refrigerant to a lower pressure than expansion valves 11, thereby resulting in a lower temperature CO2 refrigerant. Accordingly, LT system portion 20 may be used in conjunction with a freezer system or other lower temperature display cases.

LT evaporators 22 are shown receiving the cooled and expanded CO2 refrigerant from expansion valves 21. In some embodiments, LT evaporators may be associated with display freezer cases/devices (e.g., if CO2 refrigeration system 100 is implemented in a supermarket setting). LT evaporators 22 may be configured to facilitate the transfer of heat from the display cases/devices into the CO2 refrigerant. The added heat may cause the CO2 refrigerant to evaporate partially or completely. In some embodiments, the evaporation process may be an isobaric process. LT evaporators 22 are shown outputting the CO2 refrigerant via fluid conduit 23 (e.g., low temperature suction header, etc.), leading to LT compressors 24. LT compressors 24 may be fluidly coupled to fluid conduit 23 via flexible conduits 26. Flexible conduits 26 each couple to a suction side (e.g., an inlet, etc.) of LT compressors 24 and to low temperature suction header 23.

LT compressors 24 compress the CO2 refrigerant. In some embodiments, LT compressors 24 may compress the CO2 refrigerant to a pressure of approximately 30 bar (e.g., about 425 psig) having a saturation temperature of approximately 23° F. (e.g., about −5° C.). LT compressors 24 are shown outputting the CO2 refrigerant through flexible fluid conduits 26. Flexible fluid conduits 26 may be fluidly connected on one end (e.g. an inlet) to a discharge of LT compressors 24 and on the other end (e.g. an outlet) to a fluid conduit 25 shown as a low temperature discharge header. Low temperature discharge header 25 may be fluidly connected with the suction (e.g., upstream) side of MT compressors 14.

In some embodiments, the CO2 vapor that is bypassed through gas bypass valve 8 is mixed with the CO2 refrigerant gas exiting MT evaporators 12 (e.g., via fluid conduit 13). The bypassed CO2 vapor may also mix with the discharge CO2 refrigerant gas exiting LT compressors 24 (e.g., via fluid conduit 25). The combined CO2 refrigerant gas may be provided to the suction side of MT compressors 14. The combined CO2 refrigerant gas may be provided to MT compressors 14 via medium temperature suction header 29 and flexible conduits 27. Flexible conduits 27 may fluidly couple to the suction side of MT compressors 14. Flexible conduits 27 may be fluidly coupled to a fluid conduit extending from bypass valve 8.

Figure 2:
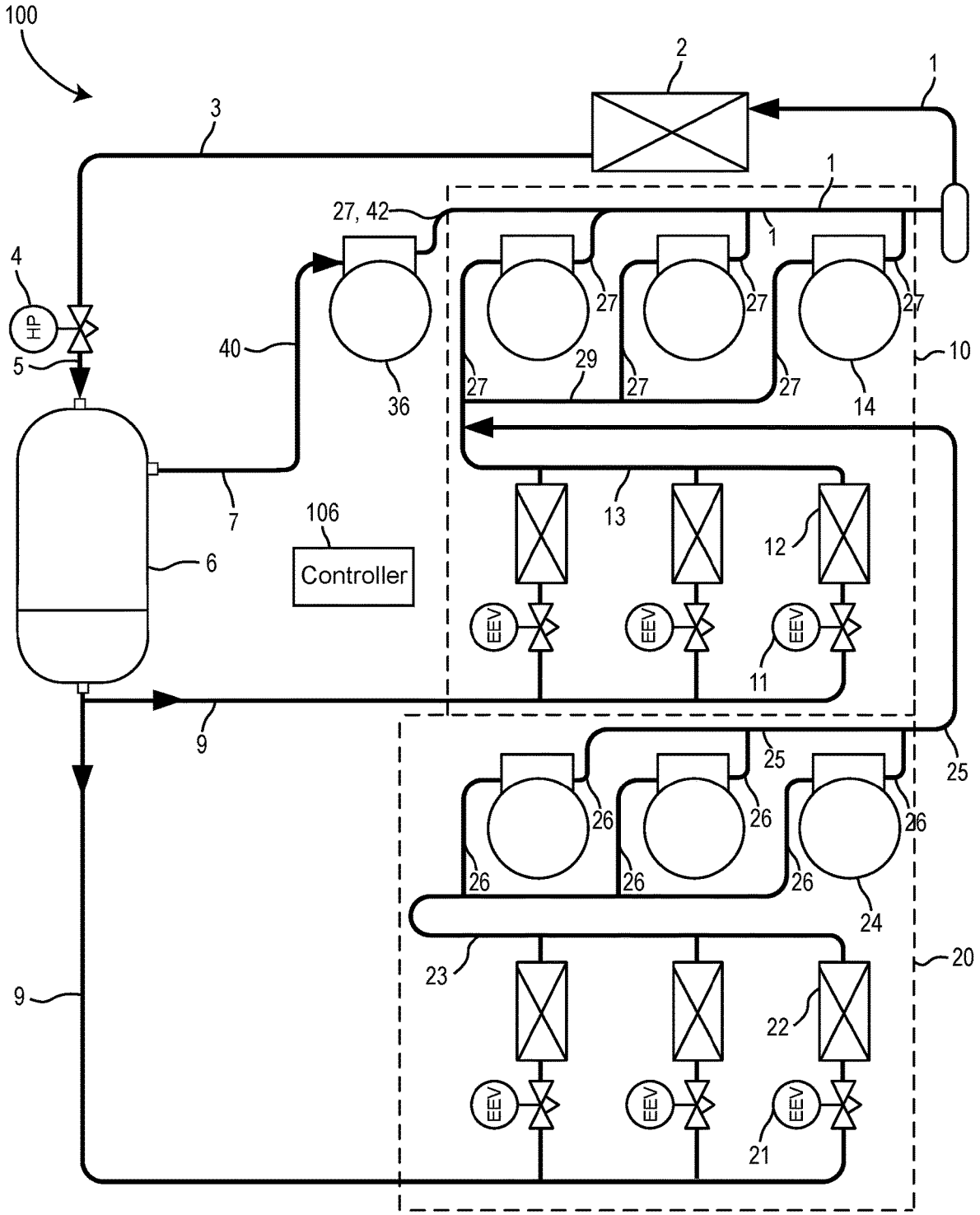
FIG. 2 is a schematic representation of the CO2 refrigeration system of FIG. 1 having a parallel compressor fluidly connected with the receiving tank and arranged in parallel with other compressors of the CO2 refrigeration system, the parallel compressor replacing the gas bypass valve for controlling the pressure within the receiving tank, according to an exemplary embodiment.

Referring now to FIG. 2, CO2 refrigeration system 100 is shown, according to another exemplary embodiment. The embodiment illustrated in FIG. 2 includes many of the same components previously described with reference to FIG. 1. For example, the embodiment shown in FIG. 2 is shown to include gas cooler/condenser 2, high pressure valve 4, receiving tank 6, MT system portion 10, and LT system portion 20. However, the embodiment shown in FIG. 2 differs from the embodiment shown in FIG. 1 in that gas bypass valve 8 has been removed and replaced with a parallel compressor 36.

Parallel compressor 36 may be arranged in parallel with other compressors of CO2 refrigeration system 100 (e.g., MT compressors 14, LT compressors 24, etc.). Although only one parallel compressor 36 is shown, any number of parallel compressors may be present. Parallel compressor 36 may be fluidly connected with receiving tank 6 and/or fluid conduit 7 via a connecting line 40. Parallel compressor 36 may be used to draw uncondensed CO2 vapor from receiving tank 6 as a means for pressure control and regulation. Advantageously, using parallel compressor 36 to effectuate pressure control and regulation may provide a more efficient alternative to traditional pressure regulation techniques such as bypassing CO2 vapor through bypass valve 8 to the lower pressure suction side of MT compressors 14.

In some embodiments, parallel compressor 36 may be operated (e.g., by a controller) to achieve a desired pressure within receiving tank 6. For example, the controller may receive pressure measurements from a pressure sensor monitoring the pressure within receiving tank 6 and activate or deactivate parallel compressor 36 based on the pressure measurements. When active, parallel compressor 36 compresses the CO2 vapor received via connecting line 40 and discharges the compressed vapor into connecting line 42. Connecting line 42 may be fluidly connected with medium temperature discharge header 1. Accordingly, parallel compressor 36 may operate in parallel with MT compressors 14 by discharging the compressed CO2 vapor into a shared fluid conduit (e.g., discharge header 1) via flexible fluid conduits 27.

Figure 3:
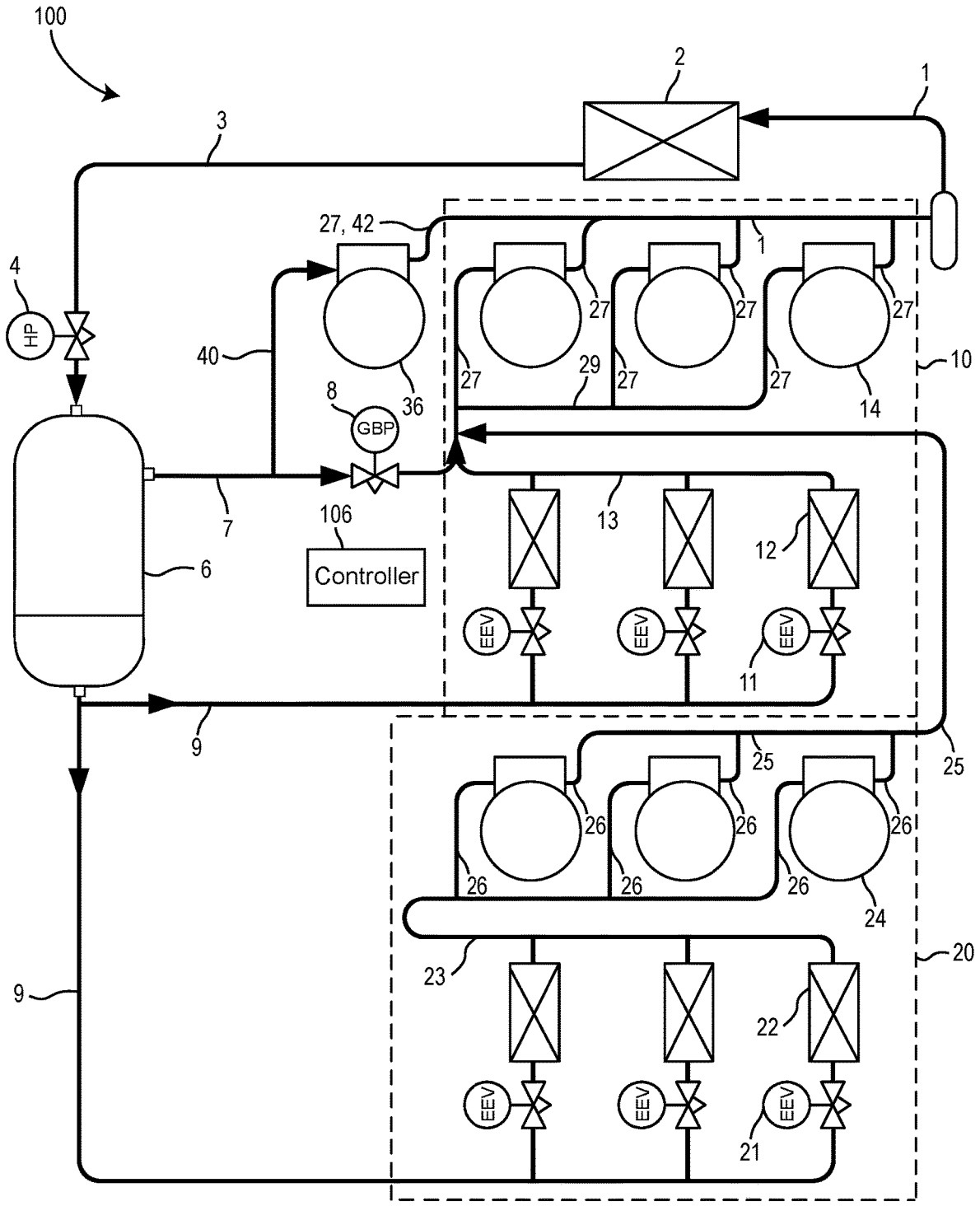
FIG. 3 is a schematic representation of the CO2 refrigeration system of FIG. 1 having the parallel compressor of FIG. 2, the gas bypass valve of FIG. 1 arranged in parallel with the parallel compressor, and a controller configured to provide control signals to the parallel compressor and gas bypass valve for controlling pressure within the receiving tank using both the gas bypass valve and the parallel compressor, according to an exemplary embodiment.

Referring now to FIG. 3, CO2 refrigeration system 100 is shown, according to another exemplary embodiment. The embodiment illustrated in FIG. 3 is shown to include all of the same components previously described with reference to FIG. 1. For example, the embodiment shown in FIG. 3 includes gas cooler/condenser 2, high pressure valve 4, receiving tank 6, gas bypass valve 8, MT system portion 10, LT system portion 20, and flexible fluid conduits 26 and 27. Additionally, the embodiment shown in FIG. 3 is shown to include parallel compressor 36, connecting line 40, and connecting line 42, as described with reference to FIG. 2.

As illustrated in FIG. 3, gas bypass valve 8 may be arranged in series with MT compressors 14. In other words, CO2 vapor from receiving tank 6 may pass through both gas bypass valve 8 and MT compressors 14. MT compressors 14 may compress the CO2 vapor passing through gas bypass valve 8 from a low pressure state (e.g., approximately 30 bar or lower) to a high pressure state (e.g., 45-100 bar). In some embodiments, the pressure immediately downstream of gas bypass valve 8 (i.e., in fluid conduit 13) is lower than the pressure immediately upstream of gas bypass valve 8 (i.e., in fluid conduit 7). Therefore, the CO2 vapor passing through gas bypass valve 8 and MT compressors 14 may be expanded (e.g., when passing through gas bypass valve 8) and subsequently recompressed (e.g., by MT compressors 14). This expansion and recompression may occur without any intermediate transfers of heat to or from the CO2 refrigerant, which can be characterized as an inefficient energy usage.

Parallel compressor 36 may be arranged in parallel with both gas bypass valve 8 and with MT compressors 14. In other words, CO2 vapor exiting receiving tank 6 may pass through either parallel compressor 36 or the series combination of gas bypass valve 8 and MT compressors 14. Parallel compressor 36 may receive the CO2 vapor at a relatively higher pressure (e.g., from fluid conduit 7) than the CO2 vapor received by MT compressors 14 (e.g., from fluid conduit 13). This differential in pressure may correspond to the pressure differential across gas bypass valve 8. In some embodiments, parallel compressor 36 may require less energy to compress an equivalent amount of CO2 vapor to the high pressure state (e.g., in fluid conduit 1) as a result of the higher pressure of CO2 vapor entering parallel compressor 36. Therefore, the parallel route including parallel compressor 36 may be a more efficient alternative to the route including gas bypass valve 8 and MT compressors 14.

Still referring to FIG. 3, in some embodiments, CO2 refrigeration system 100 includes a controller 106. Controller 106 may receive electronic data signals from various instrumentation or devices within CO2 refrigeration system 100. For example, controller 106 may receive data input from timing devices, measurement devices (e.g., pressure sensors, temperature sensors, flow sensors, etc.), and user input devices (e.g., a user terminal, a remote or local user interface, etc.). Controller 106 may use the input to determine appropriate control actions for one or more devices of CO2 refrigeration system 100. For example, controller 106 may provide output signals to operable components (e.g., valves, power supplies, flow diverters, compressors, etc.) to control a state or condition (e.g., temperature, pressure, flow rate, power usage, etc.) of system 100. According to one embodiment, vibration sensors (e.g. accelerometers, etc.) may be provided on the flexible fluid conduits 26 and/or 27 to monitor a desired vibration reduction achieved by the flexible pipe segment 104. For example, a vibration sensor may be provided on rigid pipe segment 102 and/or quick connector 101 and arranged to communicate a signal representative of vibration to the controller 106 (e.g. by a suitable wired or wireless connection). The signal representative of vibration may be used by controller 106 to monitor the vibration level of components such as quick connect 101 and for use in calculating and predicting a potential end of life point of the components for predictive maintenance planning.

In some embodiments, controller 106 may be configured to operate gas bypass valve 8 and/or parallel compressor 36 to maintain the CO2 pressure within receiving tank at a desired set point or within a desired range. In some embodiments, controller 106 may regulate or control the CO2 refrigerant pressure within gas cooler/condenser 2 by operating high pressure valve 4. Advantageously, controller 106 may operate high pressure valve 4 in coordination with gas bypass valve 8 and/or other operable components of system 100 to facilitate improved control functionality and maintain a proper balance of CO2 pressures, temperatures, flow rates, or other quantities (e.g., measured or calculated) at various locations throughout system 100 (e.g., in fluid conduits 1, 3, 5, 7, 9, 13, 23, 25, 26, 27, or 29, in gas cooler/condenser 2, in receiving tank 6, in connecting lines 40 and 42, etc.).

Referring generally to FIGS. 1-3, each of the illustrated embodiments is shown to include controller 106. Controller 106 may receive electronic data signals from one or more measurement devices (e.g., pressure sensors, temperature sensors, flow sensors, etc.) located within CO2 refrigeration system 100. Controller 106 may use the input signals to determine appropriate control actions for control devices of CO2 refrigeration system 100 (e.g., compressors, valves, flow diverters, power supplies, etc.).

In some embodiments, controller 106 may be configured to operate gas bypass valve 8 and/or parallel compressor 36 to maintain the CO2 pressure within receiving tank 6 at a desired set point or within a desired range. In some embodiments, controller 106 operates gas bypass valve 8 and parallel compressor 36 based on the temperature of the CO2 refrigerant at the outlet of gas cooler/condenser 2. In other embodiments, controller 106 operates gas bypass valve 8 and parallel compressor 36 based a flow rate (e.g., mass flow, volume flow, etc.) of CO2 refrigerant through gas bypass valve 8. Controller 106 may use a valve position of gas bypass valve 8 as a proxy for CO2 refrigerant flow rate.

Controller 106 may include feedback control functionality for adaptively operating gas bypass valve 8 and parallel compressor 36. For example, controller 106 may receive a set point (e.g., a temperature set point, a pressure set point, a flow rate set point, a power usage set point, etc.) and operate one or more components of system 100 to achieve the set point. The set point may be specified by a user (e.g., via a user input device, a graphical user interface, a local interface, a remote interface, etc.) or automatically determined by controller 106 based on a history of data measurements.

Controller 106 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some embodiments, controller 106 is a local controller for CO2 refrigeration system 100. In other embodiments, controller 106 is a supervisory controller for a plurality of controlled subsystems (e.g., a refrigeration system, an AC system, a lighting system, a security system, etc.). For example, controller 106 may be a controller for a comprehensive building management system incorporating CO2 refrigeration system 100. Controller 106 may be implemented locally, remotely, or as part of a cloud-hosted suite of building management applications.

The construction and arrangement of the elements of the CO2 refrigeration system with flexible compressor discharge coupling as shown in the exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

What is claimed is:

1. A CO2 refrigeration system, comprising:

a receiving tank configured to contain a quantity of liquid and gaseous CO2;

a condenser fluidly coupled to the receiving tank;

a low temperature system fluidly coupled to the receiving tank, the low temperature system comprising:

a plurality of low temperature evaporators;

a plurality of low temperature expansion valves;

a plurality of low temperature compressors;

a low temperature suction header;

a low temperature discharge header; and a plurality of flexible low temperature conduits fluidly coupling the low temperature compressors to the low temperature discharge header and the low temperature suction header, each of the plurality of flexible low temperature conduits having a burst pressure of up to 140 bar, at least one of the plurality of flexible low temperature conduits comprises a respective flexible low temperature conduit-quick connect;

a medium temperature system fluidly coupled to the receiving tank and the low temperature system, the medium temperature system comprising:

a plurality of medium temperature evaporators;

a plurality of medium temperature expansion valves;

a plurality of medium temperature compressors;

a medium temperature suction header;

a medium temperature discharge header; and a plurality of flexible medium temperature conduits fluidly coupling the medium temperature compressors to the medium temperature discharge header and the medium temperature suction header, each of the plurality of flexible medium temperature conduits having a burst pressure of up to 140 bar, at least one of the plurality of flexible medium temperature conduits comprises a respective flexible medium temperature conduit-quick connect;

one or more vibration sensors coupled to the respective flexible medium temperature conduit-quick connect and configured to communicate a signal representative of vibration; and a controller configured to perform operations comprising:

identifying the signal representative of vibration; and based on the signal representative of vibration, calculating a potential end of life point for at least one of the plurality of flexible medium temperature conduits.

2. The CO2 refrigeration system of claim 1, wherein:

each of the plurality of flexible medium temperature conduits comprise:

the flexible medium temperature conduit-quick connect positioned on a first side;

a rigid pipe positioned on a second side; and a flexible pipe extending between the flexible medium temperature conduit-quick connect and the rigid pipe; and each of the plurality of flexible low temperature conduits comprise:

a flexible low temperature conduit-quick connect positioned on a first side;

a rigid pipe positioned on a second side; and a flexible pipe extending between the flexible medium temperature conduit-quick connect and the rigid pipe.

3. The CO2 refrigeration system of claim 2, wherein the quick connects are coupled to either the low temperature discharge header or the medium temperature discharge header, and the rigid pipes are coupled to a discharge of one of the plurality of low temperature compressors or one of the plurality of medium temperature compressors, respectively.

4. The CO2 refrigeration system of claim 2, wherein the quick connects are coupled to the low temperature suction header or the medium temperature suction header, and the rigid pipe is coupled to a suction of one of the plurality of low temperature compressors or one of the plurality of medium temperature compressors, respectively.

5. The CO2 refrigeration system of claim 2, wherein the flexible pipe is a two layered material construction.

6. The CO2 refrigeration system of claim 2, wherein the flexible pipe comprises a three layered material construction.

7. The CO2 refrigeration system of claim 1, further comprising:

a gas bypass valve arranged in series with the plurality of medium temperature compressors, the gas bypass valve configured to receive the gaseous CO2 from receiving tank;

a parallel compressor arranged in parallel with both the gas bypass valve and the plurality of medium temperature compressors, the controller further configured to perform operations comprising operating the gas bypass valve and the parallel compressor to maintain a pressure within the receiving tank at least one of a desired set point or within a desired range; and wherein one or more of the plurality of flexible medium temperature conduits couple the plurality of medium temperature compressors to the gas bypass valve via the medium temperature suction header and to the parallel compressor via the medium temperature discharge header.

8. The CO2 refrigeration system of claim 1, wherein the controller is further configured to perform operations comprising, based on the potential end of life point for at least one of the plurality of flexible medium temperature conduits or the flexible low temperature conduits, determining a predictive maintenance plan.

9. A CO2 refrigeration system, comprising:

a receiving tank configured to contain a quantity of liquid and gaseous CO2;

a condenser fluidly coupled to the receiving tank;

a plurality of evaporators;

a plurality of expansion valves fluidly disposed between the evaporators and the receiving tank;

a plurality of compressors fluidly coupled to the plurality of evaporators;

a plurality of flexible conduits fluidly coupled to an outlet of the compressors and an inlet of the compressors, at least a portion of the plurality of flexible conduits having a burst pressure of up to 140 bar, at least one of the plurality of flexible conduits comprises a quick connect;

one or more vibration sensors coupled to at least one of the quick connect and configured to communicate a signal representative of vibration; and a controller configured to perform operations comprising:

identifying the signal representative of vibration; and based on the signal representative of vibration, calculating a potential end of life point for at least one of the flexible conduits.

10. The CO2 refrigeration system of claim 9, wherein:

the quick connect is positioned on an outlet side; and each of the plurality of flexible conduits further comprise:

a rigid pipe positioned on an inlet side; and a flexible pipe extending between the quick connect and the rigid pipe.

11. The CO2 refrigeration system of claim 10, wherein the quick connect is coupled to a discharge header that fluidly communicates with the condenser, and the rigid pipe is coupled to a discharge of the compressors.

12. The CO2 refrigeration system of claim 10, wherein the quick connect is coupled to a suction header that fluidly communicates with the evaporators, and the rigid pipe is coupled to a suction of the compressors.

13. The CO2 refrigeration system of claim 10, wherein the flexible pipe comprises a two layered material construction.

14. The CO2 refrigeration system of claim 13, wherein the two layered material construction comprises:

a polytetrafluoroethylene inner core; and a 304 stainless steel outer wire braid cover.

15. The CO2 refrigeration system of claim 10, wherein the flexible pipe comprises a three layered material construction.

16. The CO2 refrigeration system of claim 15, wherein the three layered material construction comprises:

an inner core elastomer layer;

a middle steel braided wire layer; and an outer elastomer cover layer.

17. The CO2 refrigeration system of claim 15, wherein the three layered material construction comprises:

a corrugated inner core layer; and a double outer wire braid layer.

18. The CO2 refrigeration system of claim 9, wherein the controller is further configured to perform operations comprising based on the potential end of life point for at least one of the flexible conduits, determining when in time to perform predictive maintenance on at least one of the flexible conduits before the potential end of life point.

19. A CO2 refrigeration system, comprising:

one or more compressors;

a compressor discharge header;

a compressor suction header;

one or more flexible conduits configured to fluidly couple an outlet of the one or more compressors to the compressor discharge header and an inlet of the one or more compressors to the compressor suction header, at least one of the flexible conduits comprises a quick connect;

one or more vibration sensors coupled to at least one of the quick connect and configured to communicate a signal representative of vibration; and a controller configured to perform operations comprising:

identifying the signal representative of vibration; and based on the signal representative of vibration, calculating a potential end of life point for at least one of the flexible conduits; and based on the potential end of life point, calculating a predictive maintenance plan for performing maintenance on the at least one of the flexible conduits before the calculated potential end of life point of the at least one of the flexible conduits.

20. The CO2 refrigeration system of claim 19, wherein:

the quick connect is positioned on an outlet side; and each of the one or more flexible conduits further comprise:

a rigid pipe positioned on an inlet side; and a flexible pipe extending between the quick connect and the rigid pipe.

21. The CO2 refrigeration system of claim 20, wherein the quick connect is coupled to the compressor discharge header, and the rigid pipe is coupled to the outlet of the one or more compressors.

22. The CO2 refrigeration system of claim 20, wherein the quick connect is coupled to the compressor suction header, and the rigid pipe is coupled to the inlet of the one or more compressors.

23. The CO2 refrigeration system of claim 20, wherein the flexible pipe dampens vibration or pressure pulsation of the one or more flexible conduits.

24. The CO2 refrigeration system of claim 19, wherein the one or more flexible conduits are configured to withstand a temperature of up to 285° F.

* * * * *